United States Patent [19]

Ainsworth et al.

[11] 4,100,941

[45] Jul. 18, 1978

[54] RAPIER LOOMS

[75] Inventors: David Ainsworth, Darwen; Allan Beckett, Blackburn; Cyril Millward Atkinson, Barrowford, all of England

[73] Assignee: Northrop Weaving Machinery Limited, England

[21] Appl. No.: 692,714

[22] Filed: Jun. 4, 1976

[30] Foreign Application Priority Data

May 6, 1975 [GB] United Kingdom ..... 24225/75

[51] Int. Cl.[2] ..... D03D 47/12

[52] U.S. Cl. ..... 139/449; 139/444

[58] Field of Search ..... 139/440, 441, 449, 444, 139/448

[56] References Cited

U.S. PATENT DOCUMENTS

| | | | |
|---|---|---|---|
| 643,902 | 2/1900 | Kuett | 139/441 |
| 647,854 | 4/1900 | MacDonald | 139/441 |
| 733,586 | 7/1903 | Hutchins | 139/449 |
| 3,311,137 | 3/1967 | Miangolarra | 139/449 |
| 3,364,954 | 1/1968 | Kokkinis | 139/449 |
| 3,371,688 | 3/1968 | Liebchen | 139/441 |
| 3,580,291 | 5/1971 | Piccoli | 139/448 |
| 3,916,957 | 11/1975 | Dewas | 139/449 |

*Primary Examiner*—Henry S. Jaudon

*Attorney, Agent, or Firm*—John C. Smith, Jr.

[57] ABSTRACT

A rapier for use with a rapier loom has a drive member which is spaced laterally from the rapier but extends parallel to the rapier, the rapier and drive member being connected together by the butt end of the rapier, so that in use the drive member can pass underneath the shed and need not enter the shed with the rapier.

11 Claims, 5 Drawing Figures

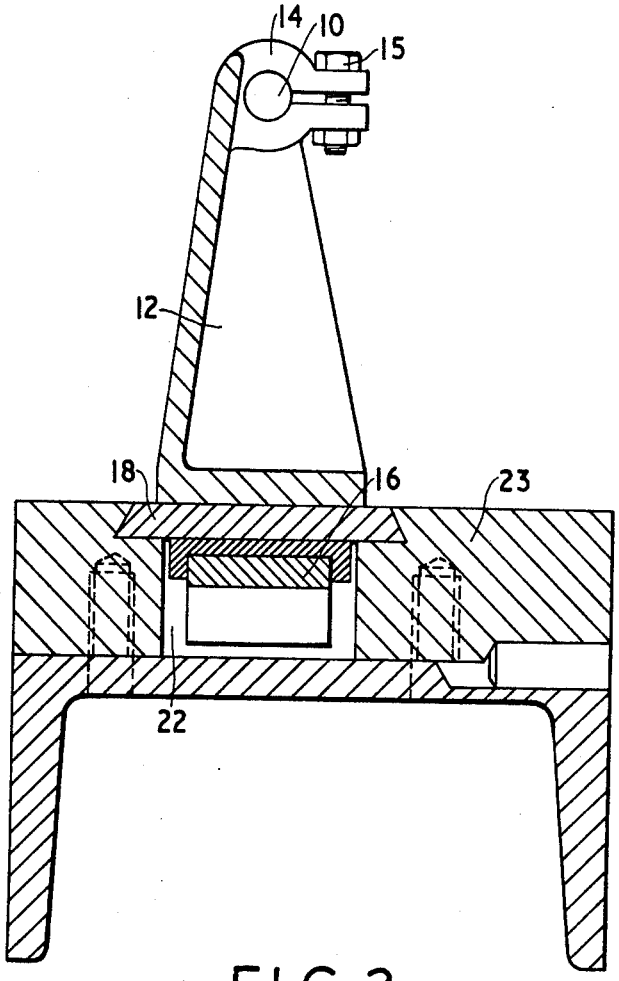
-FIG. 3-
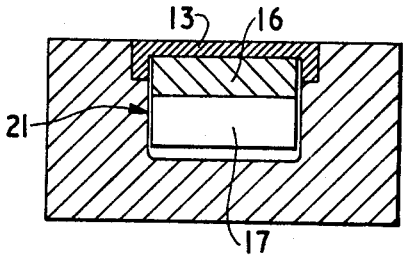
-FIG. 4-

RAPIER LOOMS

The invention relates to rapier looms and to rapiers for use therewith.

The invention provides a rapier for use with a rapier loom, the rapier having a drive member which is spaced laterally from the rapier but extends parallel with the rapier, the rapier and drive member being connected together at the butt end of the rapier, so that in use the drive member can pass underneath the shed and need not enter the shed with the rapier.

The drive member may comprise a rack.

The rapier may be made of fibre reinforced plastics or resin material, and it is preferred that the reinforcement is by carbon fibres.

It is preferred that the connection between the rapier and the drive member is such that the position of the rapier relative to the drive member may be adjusted in the direction of the longitudinal axis of the rapier.

The invention includes a rapier loom having at least one rapier as described above. The drive member may be mounted for movement in a slideway positioned below the shed of the loom, and the slideway may be enclosed such that the drive member can be lubricated without the lubricant coming into contact with fabric woven on the loom.

A positioning device may be provided at the side of the loom to position the tip of the rapier when the rapier is in the withdrawn position.

A retaining device may be provided at the side of the loom to resist any tendency for the drive member to lift out of the slideway. The retaining device may comprise a roller.

By way of example, a specific embodiment of the invention will now be described, with reference to the accompanying drawings, in which:

FIG. 3 is a view in the direction of arrow III of FIG. 1 showng the connection between the rapier and its drive member;

FIG. 4 is a section on line IV—IV of FIG. 1; and

Figure 1:
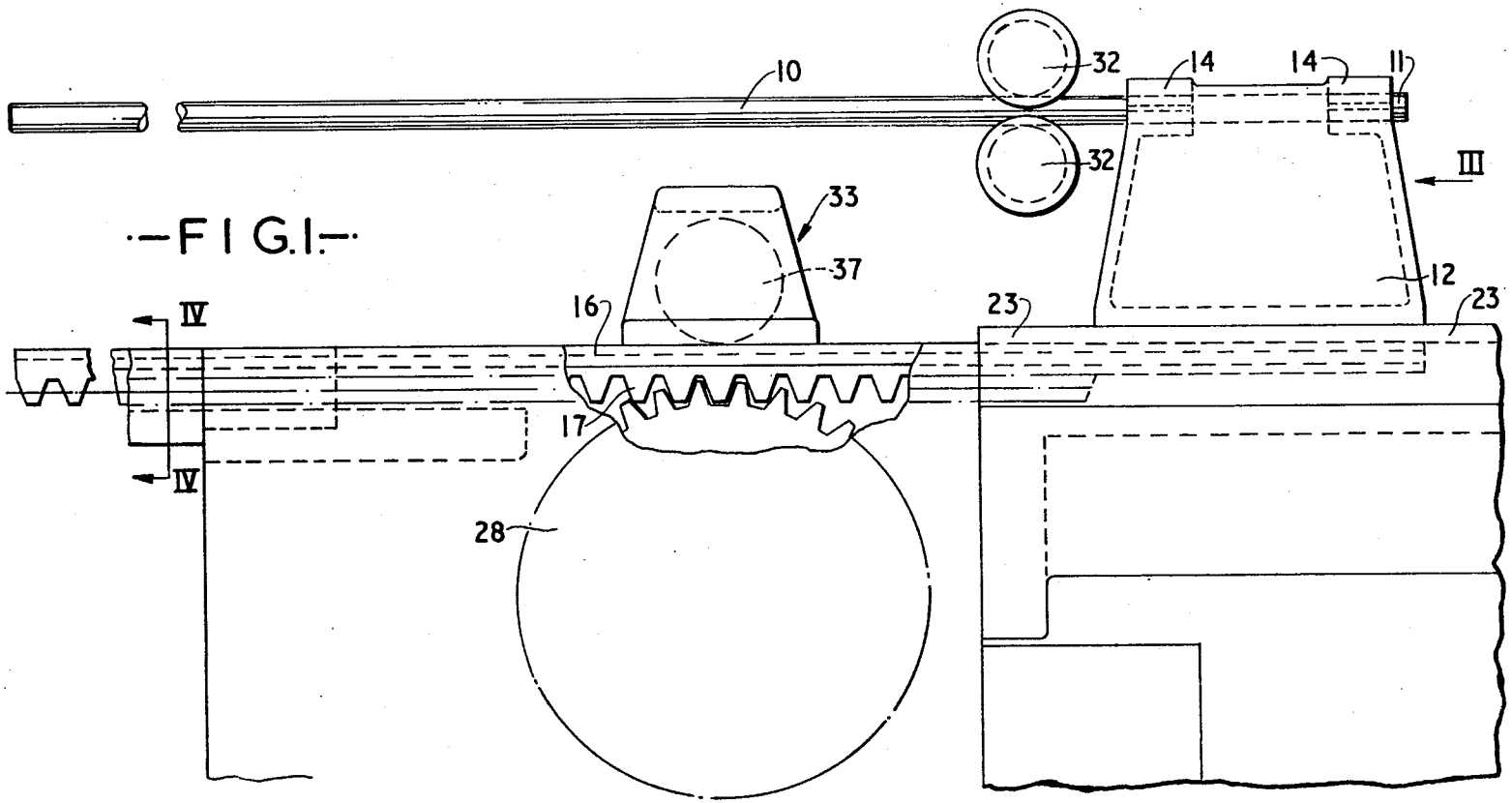
FIG. 1 is a front view of part of a loom and rapier according to the invention.

The important aspect of the rapier loom shown in the Figures concerns the rapier and its associated drive. Other aspects of the rapier loom do not form part of the invention and will not therefore be described further. The rapier 10 is best shown in FIG. 1 and comprises a pencil-like rod of carbon fibre resinforced resin. A gripper element 40 is attached to the tip of the rapier and the butt end 11 of the rapier is mounted in a connecting bracket 12. The bracket 12 has a pair of split bosses 14. The ends of each split boss are joined by a nut and bolt connection 15 so that the butt end of the rapier can be securely but adjustably clamped in the split bosses.

The base of the bracket 12 is secured to a drive member in the form of a plastic rack 16. As best shown in FIG. 4, the rack 16 has a cross-section in the form of a T, the depending teeth 17 forming the upright of the T. The toothed portion of the rack is formed from nylon and the head 13 of the T is formed from carbon fibre reinforced plastic material. At the rack which lies adjacent to the butt end of the rapier, there are no teeth on the underside of the rack and the upper part of the rack is secured to a steel plate 18 of dovetail or trapezium section, which carries the bracket 12. Along its path over the body of the loom, i.e. that part of the loom lying between the edge and centre of the shed, the rack 16 runs in a T-shaped recess or groove 21 (FIG. 4) the recess being completely closed by a cover plate (not shown). Over that part of its path which extends outwardly of the loom side, the rack 16 runs in a groove 22 in an iron support arm 23. The groove 22 has a similar shape to the groove 21, but its upper part is shaped to accomodate the steel plate 18. Because of the shape of the plate 18 it is held securely in the groove 22.

The drive for the rapier is provided from a gear wheel 28, which is of steel, and extends upwardly into the groove 21 to mesh with the teeth 17 of the nylon rack 16. The gear wheel 28 rotates back and forth so that the rack 16 reciprocates across the loom, causing the rapier 10 to reciprocate through the shed 44 supported by reed 41 and sley 42.

In order accurately to position the gripper element of the rapier when the rapier is fully withdrawn, a positioning device is provided, comprising a pair of pulley wheels 32 between the rapier 10 passes. The length of the rapier is such that even when it is at the full extent of its travel to the right as viewed in FIG. 1, the tip of the rapier remains between the pulleys 32 so that it is supported by them.

A bracket 33 of top-hat section, straddles the groove 21 above the gear 28. A roller 37 is mounted for rotation between the sides of the bracket 33 and this roller 37 is in engagement with the upper face of the rack 16, immediately above the point where the gear wheel 28 engages the teeth of the rack, and the roller thus holds the rack firmly in the groove 21, and maintains driving engagement between the teeth of the rack and the gear wheel 28.

The provision of the separate driving member for the rapier, which does not enter the shed with the rapier, has a number of advantages. The rapier can be made finer and lighter than conventional rapiers, and can for example be formed from carbon fibre reinforced resin, instead of from steel. It is also possible to lubricate the driving member, which is not possible if the driving member enters the shed. Furthermore, the position of the rapier 10 relative to the rack 16 may be adjusted by slackening the nut and bolt connections 15, moving the rapier 10 to the desired position, and re-tightening the connections. This facilitates the initial setting-up of the rapier and the making of later adjustments, for example when weaving a different width of fabric.

Figure 2:
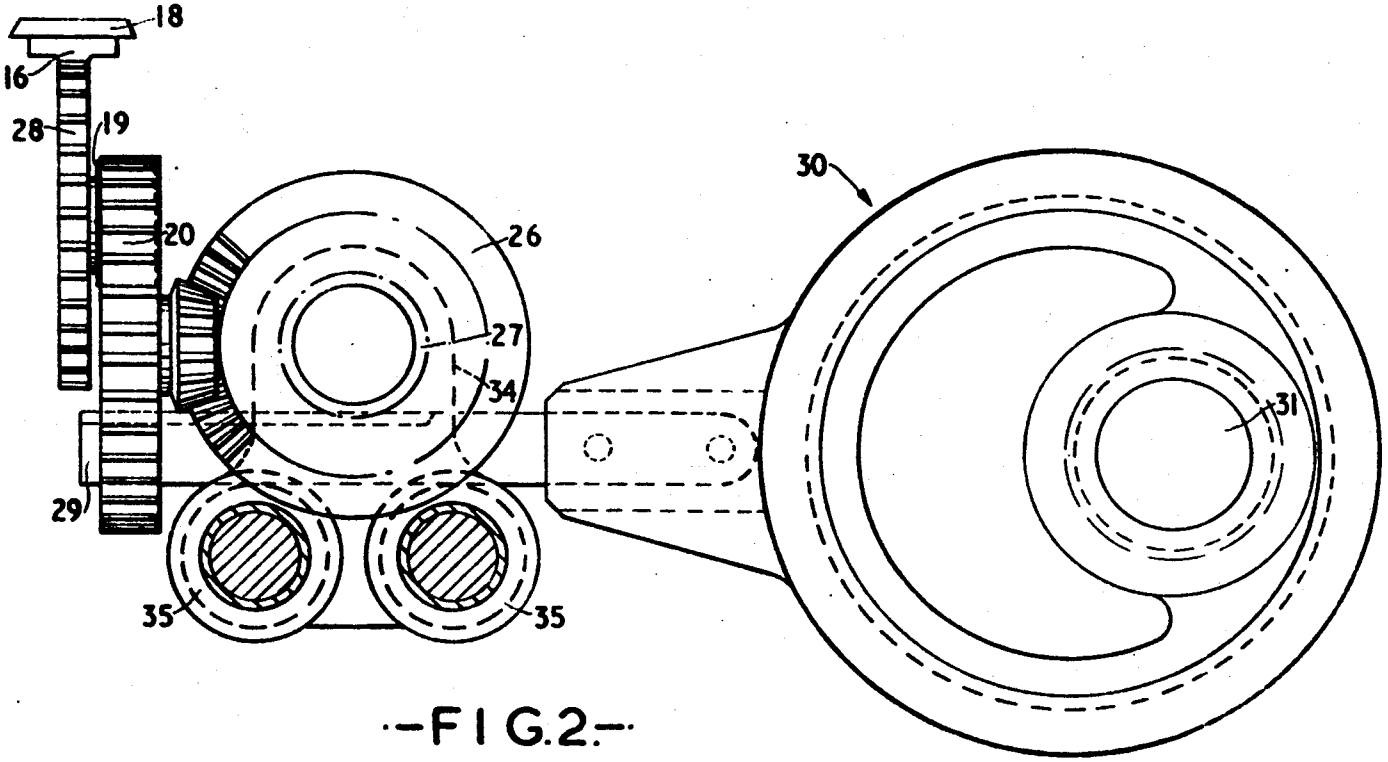
FIG. 2 is a transverse section through driving elements of the loom.
Figure 5:
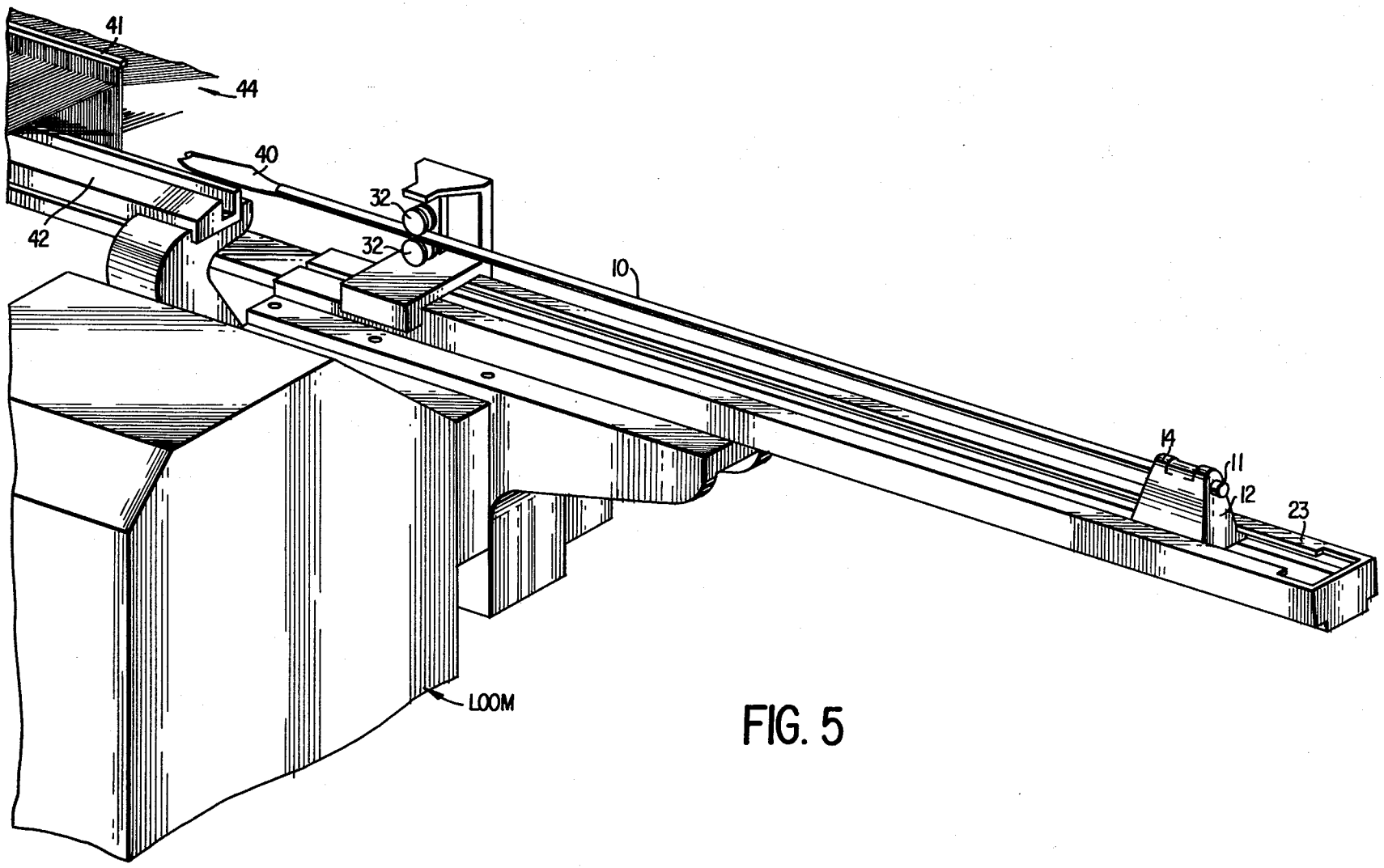
FIG. 5 is a perspective view of the rapier in operative position adjacent a loom.

The driving elements, for rotating the gear wheel 28 to and fro, are shown in FIG. 2.

The gear wheel 28 has a pinion 19 co-axial therewith, and this pinion meshes with a further gear wheel 20. The gear wheel 20 has a bevel gear 25 co-axial therewith, which meshes with a further bevel gear 26. The bevel gear 26 is mounted on a shaft which also carries a pinion wheel 27 in mesh with a rack 29. The rack 29 is driven in a reciprocatory manner by an eccentric 30 which is mounted on a drive shaft 31. To accomodate the swinging movement of the rack 29 caused by the vertical component of motion of the eccentric 30, the rack is supported on a swinging carriage comprising a pair of brackets 34 mounted one on each side of assembly made up of the bevel gear 26, pinion 27 and rack 29. Mounted side by side between the two brackets, with their axes parallel, are a pair of pulley wheels 35 which engage with the underside of the rack to urge the rack against the pinion 27.

We claim:

1. A rapier loom wherein a rapier reciprocally moves into and out of a shed, said loom comprising:

(a) means supporting said shed, (b) at least one longitudinally extending rapier having a butt end and arranged to pass through said shed, (c) a gripper element at the end of said rapier opposite said butt end adapted to engage and transport a weft thread through said shed, (d) means defining an upwardly facing longitudinally extending slide channel extending below said rapier and shed and outwardly from one side of said shed and parallel to said rapier, (e) a drive rack slidably mounted in said slide channel below said rapier and shed and including a plurality of teeth facing downwardly, (f) drive means including a drive gear arranged below said shed and slide channel and projecting upwardly into said slide channel to mesh with said teeth and reciprocate said drive rack and means for rotating said drive gear back and forth, and (g) means securing together said drive rack adjacent one end thereof and said rapier adjacent said butt end in spaced relationship with said drive rack and rapier extending substantially parallel to each other in the same direction from said securing means such that when said drive rack is reciprocated below said shed said rapier is simultaneously reciprocated into and out of said shed to transport said weft thread through said shed.

2. A rapier loom as defined in claim 1 further comprising means covering at least the portion of said upwardly facing slide channel below said shed to isolate said drive rack from said shed and permit said drive rack to be lubricated without the lubricant coming into contact with fabric woven on the loom.

3. A rapier loom as defined in claim 1 further comprising means for slidably retaining said drive rack in said slide channel.

4. A rapier loom as defined in claim 3 wherein said retaining means comprises track means in said slide channel and means on said drive rack for engaging said track means.

5. A rapier loom as defined in claim 3 wherein the end portion of said drive rack adjacent said securing means is of dovetail or trapezium section and the side walls of the portion of said slide channel extending outwardly from one side of said shed have a complementary configuration to slidably retain said drive rack in said slide channel.

6. A rapier loom as defined in claim 1 further comprising pinion means and a second rack for driving said drive gear, and an eccentric rotary means connected to said second rack for driving said second rack.

7. A rapier loom as defined in claim 1 in which said rapier is made of fiber reinforced plastic material.

8. A rapier loom as defined in claim 7 in which the reinforcement is by carbon fibers.

9. A rapier loom as defined in claim 1 wherein said securing means includes means for adjusting the position of said rapier relative to said drive rack in the direction of the longitudinal axis of said rapier.

10. A rapier loom as defined in claim 1 further comprising positioning means at the side of said shed to position the free end of said rapier when said rapier is in the withdrawn position.

11. A rapier loom as defined in claim 10 wherein said positioning means comprises a pair of pulleys between which said rapier is arranged to run.

* * * * *